US006321664B1

(12) United States Patent
Damour et al.

(10) Patent No.: US 6,321,664 B1
(45) Date of Patent: Nov. 27, 2001

(54) FOLDABLE TABLE-TENNIS TABLE FITTED WITH LOCKING MEANS

(75) Inventors: Philippe Damour, Lille; Christophe Denizart, Lesquin; Christophe Graciet, Villeneuve d'Ascq, all of (FR)

(73) Assignee: Decathlon, Villeneuve d'Ascq (FR)

( * ) Notice: Subject to any disclaimer, the term of this patent is extended or adjusted under 35 U.S.C. 154(b) by 0 days.

(21) Appl. No.: 09/472,261

(22) Filed: Dec. 27, 1999

(Under 37 CFR 1.47)

(30) Foreign Application Priority Data

Dec. 31, 1998 (FR) ..... 98 16787

(51) Int. Cl.[7] ..... A47B 3/083
(52) U.S. Cl. ..... 108/168; 108/129
(58) Field of Search ..... 108/129, 130, 108/131, 115, 168, 169, 167, 166, 172, 173, 174, 171; 248/188.6, 439

(56) References Cited

U.S. PATENT DOCUMENTS 2,991,139 * 7/1961 Fihe ..... 108/168
3,604,372 * 9/1971 Hewett ..... 108/129 X
4,027,600 * 6/1977 Mueller ..... 108/169
4,489,661 * 12/1984 Fitzgerald ..... 108/169
4,573,415 * 3/1986 Ramey ..... 108/129
5,020,799 * 6/1991 Chang ..... 108/130 X
6,065,802 * 5/2000 Bue ..... 108/168 X

* cited by examiner

*Primary Examiner*—Jose V. Chen
(74) *Attorney, Agent, or Firm*—Wolf, Greenfield & Sacks P.C.

(57) ABSTRACT

The table-tennis table comprises a foldable table-tennis table comprising a support and two table tops which are provided with hinged legs and are movable between a horizontal position for play and a vertical position for storage, together with positioning wheels projecting from the side edges of the two table tops, substantially vertical guiding slideways for guiding the positioning wheels, which slideways are supported by or integrated in the support, and a lock for locking each table top in a horizontal position for play, associated with an actuator accessible to the user. The lock has, for each positioning wheel, two distinct parts, namely:

a) a locking part secured to the support, movable longitudinally relative thereto, and serving in its normal, inactive position, to hold the positioning wheel stationary in position in the corresponding slideway; and b) an unlocking part secured to the side edge of the table top and secured to the actuator, and wherein the actuator is suitable for causing the unlocking part to pass from its normal, inactive position to an active position in which it pushes back the locking part and releases the positioning wheel.

8 Claims, 3 Drawing Sheets

FOLDABLE TABLE-TENNIS TABLE FITTED WITH LOCKING MEANS

The present invention relates to a foldable table-tennis table having means for locking two table tops, i.e. means enabling each of the table tops to be locked in position when in a horizontal position for play, it being necessary to actuate said locking means to move the table top from this horizontal position to a vertical position for storage.

BACKGROUND OF THE INVENTION

A table of this type is already known from document FR 2 729 302. In the solution recommended by that document, the locking means for each table top comprise, projecting from the side edge of the table top, a bolt of axis perpendicular to said edge and movable along said axis; in addition, the support of the table presents, facing each side edge, a catch-forming housing for receiving the corresponding bolt. Thus, the locking means are actuated in transverse displacement, i.e. in the direction perpendicular to the side edge of the table top. In a preferred embodiment, the locking bolt is integrated in a guide finger which projects from the side edge of the table top remote from the zone where the user is to be found when seeking to fold the table, and thus seeking to actuate the locking means to release the table top. In a simplified embodiment, shown in FIG. 2 of that document, actuation is obtained by means of a flexible tie connected to the two locking bolts and passing, under the table top, close to the user. Under such circumstances, it is necessary to place deflectors under the table top proper so as to transform the longitudinal displacement imparted by the user when pulling on the tie into transverse displacement suitable for extracting each bolt from its housing. FIG. 6 shows a second embodiment having a handle for actuation by the user, a rod sliding in rings that are rigidly fixed to the table top, said rod being terminated by a sheath through which there passes a tie that extends between the two bolts. Tie deflectors are also provided to transform the longitudinal movement of the handle into transverse movement at the ends of the tie. Whatever the solution adopted, it is necessary to keep systems and in particular deflector systems in position fixed to the underside of the table top and suitable for transforming the traction movement exerted by the user into transverse displacement of the locking bolt.

Also known, from document U.S. Pat. No. 2,913,294, is a foldable table-tennis table of the same type as above, provided with locking means, themselves associated with actuator means accessible to the user. The locking means for each positioning wheel consist in a latch which is secured to the support and which is movable longitudinally relative thereto. When in its normal, inactive position under bias from a spring, the latch prevents the positioning wheel from moving; the actuator means consist in a flexible tie on which the user pulls to displace said part against the force of the spring, thereby releasing the positioning wheel and enabling it to move in the guiding slideway.

That configuration for the locking means presents drawbacks. The tie for actuating the locking latch extends between one end of the table top and the latch which is fixed to the support. When the table top goes from the horizontal position to the vertical position for storage, the tie moves under the same conditions and hangs down along the vertical edge of the table top which can run the risk of jamming when the table top is put back in the horizontal position.

OBJECT AND SUMMARY OF THE INVENTION

The object of the invention is to propose a table which mitigates the above-specified drawback.

The table-tennis table of the invention is a table which is foldable and which comprises, as known from document U.S. Pat. No. 2,913,294, a support and two table tops which are provided with hinged legs and which are movable between a horizontal position for play and a vertical position for storage. It also has positioning wheels, mounted to project from the side edges of the two table tops, substantially vertical guiding slideways for said positioning wheels, which slideways are supported by or integrated in the support, and finally means for locking each table top in the horizontal position for play, associated with actuator means accessible to the user.

In a manner characteristic of the invention, the locking means comprise, for each positioning wheel, two distinct parts, namely:

a) a locking part secured to the support, movable longitudinally relative thereto, and serving in its normal, inactive position, to hold the positioning wheel stationary in position in the corresponding slideway; and b) an unlocking part secured to the side edge of the table top and to the actuator means. In addition, said actuator means are adapted to cause the unlocking part to pass from its normal, inactive position to an active position in which it pushes back the locking part and releases the positioning wheel.

Thus, the structural relationship between the actuator means and the unlocking part is independent of the position of the table top, i.e. regardless of whether it is horizontal or vertical.

Preferably, the locking part is fitted with return means, in particular a spring, and the unlocking part pushes back the locking part against the force of the return means. Thus, when after unlocking the table top, the user moves it from the horizontal position for play to the vertical position for storage, the locking part returns automatically into its initial position.

In a preferred embodiment, the locking part is a part that pivots angularly about a transverse axis fixed to the support.

By way of example, the locking part is a flat, hook-forming part with a concave indentation, and its pivot axis is fixed firstly to the support vertically in register with the guiding slideway, and secondly to the hook towards the end of its concave indentation. Under the force of the return means, when the hook is in its normal, locking position, it is placed in such a manner as to hold a wheel captive, which wheel is either the positioning wheel itself or else an intermediate wheel mounted between the positioning wheel and the side edge of the table top; in addition, the edge of the hook adjacent to the concave indentation and remote from the pivot axis is disposed obliquely relative to the longitudinal direction of the slideway.

The purpose of the oblique disposition of the edge of the hook is to enable the wheel to be put into its end-of-stroke locking position when going from the vertical position for storage to the horizontal position for play. While this change of position is taking place, the wheel is no longer held captive by the hook but moves longitudinally in the guiding slideway (if it is a positioning wheel) or relative thereto (if it is an intermediate wheel). During this displacement, the wheel presses against the oblique edge of the hook, and because the edge is oblique, it pushes back the hook against the force of the return means, causing it to pivot until the wheel no longer presses against said edge but against the concave indentation of the hook, thereby causing the hook to pivot in the opposite direction, returning it to its normal position, under drive from the return means. The hook then holds the wheel captive in the locking position.

Preferably, the unlocking part is itself a part that pivots angularly about a transverse axis fixed to the side edge of the table top.

When the locking part is a hook as described above, the unlocking part is an arm pivoting about the axis of the wheel, said arm having a bearing face suitable for engaging the edge of the hook.

In a preferred embodiment, the table-tennis table of the invention also includes means for locking the table top when it is in the vertical position for storage, associated with actuator means that can be actuated by the foot of the user. Preferably, these means comprise a hook having the configuration described above. In the above case, the pivot axis of the hook is fixed to the support, vertically in register with the slideway, and above it. In this case, the pivot axis is fixed to the support, vertically in register with the slideway, and beneath it. In addition, the hook has a bottom extension extending beyond the pivot axis, said extension being provided with a transverse bearing rod. The purpose of this bearing rod is to enable the user to release the wheel from its locking position by lifting said rod with a foot. This rod, which can be actuated directly by the user when the table top is in its vertical position for storage, thus performs the same function as the unlocking part.

BRIEF DESCRIPTION OF THE DRAWINGS

The present invention will be better understood on reading the following description of a preferred embodiment of a foldable table-tennis table fitted with two locking systems for its table tops, for locking both in a horizontal position for play and in a vertical position for storage, and shown in the accompanying drawings, in which.

MORE DETAILED DESCRIPTION

Figure 1:
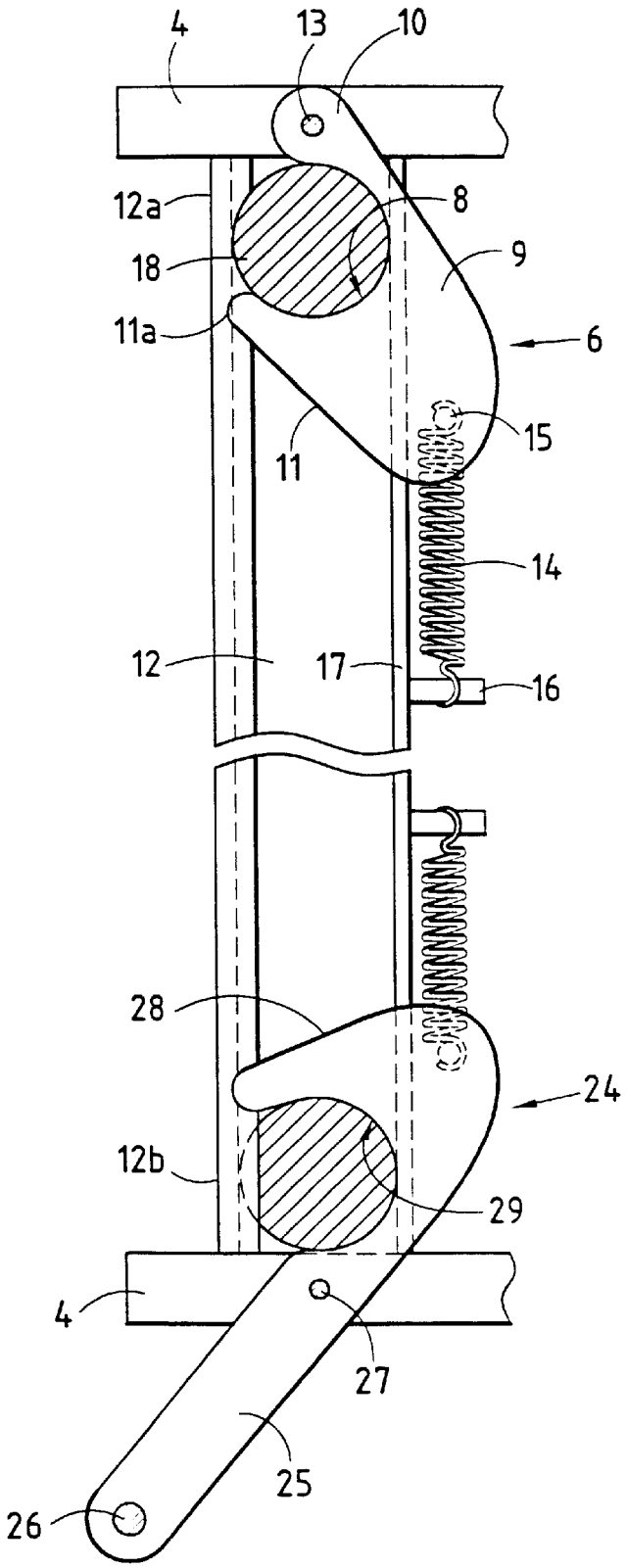
FIG. 1 is a diagrammatic face view of two locking systems disposed respectively at the top and at the bottom of a guiding slideway.
Figure 2:
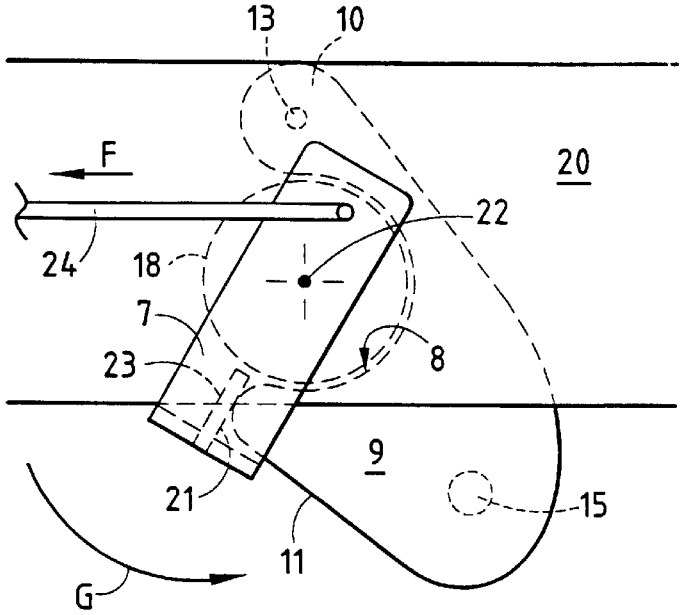
FIG. 2 is a diagrammatic face view of an unlocking part fixed to the side edge of the table top.
Figure 3:
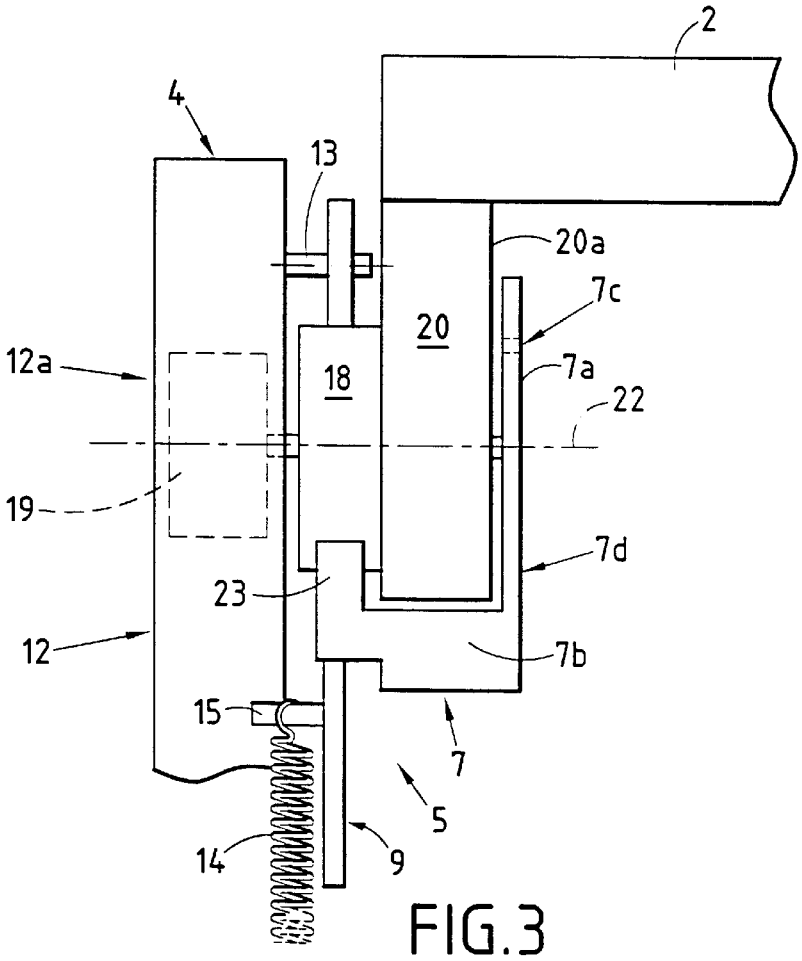
FIG. 3 is a diagrammatic end view of the part shown in FIG. 2, as seen looking in the direction opposite to arrow F.

In conventional manner, a foldable table-tennis table comprises two table tops 2 associated with hinged legs 3 and a support 4, preferably mounted on casters. Each table top 2 can be moved relative to the fixed support 4 between a horizontal position for play and a vertical position for storage. For this purpose, four positioning wheels 5 are mounted on the respective side edges of the table tops, projecting from said side edges so as to penetrate into vertical slideways supported by or integrated in the support 4. These dispositions are known, in particular from document FR 2 729 302.

Each table top 2 is constituted by a plane panel having fixed on the periphery thereof (except on its side where the net is placed) a vertical rim that is perpendicular to the plane of the panel and that is commonly referred to as a "belt". In the present specification, the terms "belt" and "edge" are used interchangeably.

The table 1 is fitted with first locking means enabling the two table tops to be held in position when they are in the horizontal position for play. It is also fitted with second locking means enabling each table top to be held in a vertical position for storage.

In both cases, the locking is active, i.e. locking is effective when said means are in the normal position, at rest, and unlocking takes place when said means are actuated.

The first locking means 5 comprise two essential parts, namely: a locking part 6 and an unlocking part 7.

The locking part 6 can be seen clearly in FIG. 1. It is a flat part, having a concave indentation 8, and this part is referred to below as being a hook 9. As its element which is active in the context of the present invention, this hook 9 has a side branch 10 adjacent to the concave indentation 8, and an edge 11 which is also adjacent to the concave indentation 8, and opposite to the side branch 10. The hook 9 is fixed to the support 4 vertically in register with a slideway 12, at the top thereof and about a pivot axis 13. A return spring 14 is tensioned between two tensioning rods 15 and 16, the first rod 15 being fixed to the hook 9 opposite from its pivot axis 13, perpendicularly to the plane of said hook 9, while the second rod 16 is fixed to the outside of one of the uprights 17 forming the slideway 12.

FIG. 1 shows the normal or rest position of the hook 9. The concave indentation 8 of the hook 9 is centered on the slideway 12, and at the top 12*a* thereof. This concave indentation 8 can then be used as a housing either to receive the positioning wheel 19, or else and as in the example shown, an intermediate wheel 18 which is fixed axially adjacent to the positioning wheel 19 and to the side edge 20 of the table top. This intermediate wheel 18 occupies only the gap between the slideway 12 and the belt 20.

In the normal position, at rest, the intermediate wheel 18 is held captive in the concave indentation 8 so that it is impossible to move the positioning wheel 19 down the slideway 12. The table top 2 is thus actively locked in its horizontal position for play.

Figure 4:
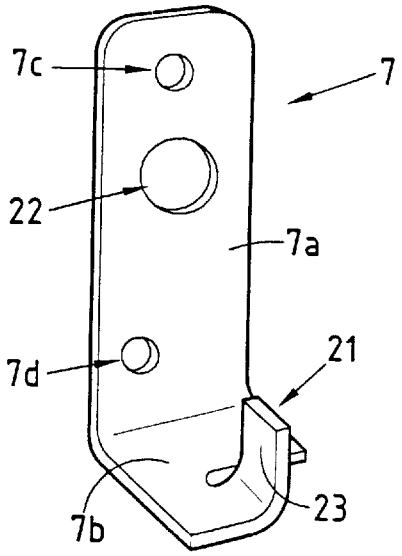
FIG. 4 is a perspective view of the unlocking part of FIG. 2.

The unlocking part 7 is a part which has a bearing face 21. In the example shown in FIG. 4, the unlocking part 7 is an L-shaped bracket, with a first limb 7*a* of the bracket being pivotally mounted on the inside face 20*a* of the belt 20 about a pivot axis 22, said axis corresponding to the axis of the positioning wheel 19 and of the intermediate wheel 18. An angled portion 23 is formed in the second limb 7*b* of the bracket by cutting 35 and folding. It is the outside face of this angled portion 23 which constitutes the bearing face 21.

The unlocking part 7 is actuated by the user by means of a strap 24 which is fixed to the first limb 7*a* of the bracket, at the top 7*c* thereof, beyond its pivot axis 22.

In the normal position, the unlocking part 7 has its bearing face 21 pressed against the locking part 6, and more particularly against the end 11*a* of the edge 11, close to the concave indentation 8.

To perform unlocking, the user exerts traction on the strap 24 in the direction of arrow F, thereby causing the unlocking part 7 to pivot about its axis 22. During this pivoting, the bearing face 21 pushes back the edge 11*a* of the hook 9 so that it is moved angularly in the direction of arrow G about the pivot axis 13 of said hook 9. To obtain unlocking, it is necessary for the angular movement to be such that the end edge 11*a* of the hook 9 is completely retracted so as to allow the intermediate wheel 18 to move vertically parallel to the slideway 12. In practice, the user actuating the strap 24 tries simultaneously to lift the tabletop 2 via the transverse edge 2*a* of the top which the user is holding. As soon a the hook 9 has been pushed back far enough by the unlocking part 7, the table top 2 tilts with the positioning wheel 19 moving vertically down the slideway 12. Once the table top 2 has begun to tilt, the user lets go the strap 24, thus allowing the unlocking part 7 to return to its initial position under the effect of a return spring (not shown in the figures) which connects the zone 7*d* of the first limb 7*a* of said part 7 to the inside face 20*a* of the belt 20. Once released from the unlocking part 7, the hook 9 returns to its normal, rest position under the effect of its return spring 14, which position is shown in FIG. 1.

When the user tilts the table top 2 from its vertical position for storage towards its horizontal position for play, the positioning wheel 19 moves up the slideway 12 towards the top 12*a* thereof. In so doing, the intermediate wheel 18 comes into contact with the edge 11 of the hook 9. This edge slopes obliquely, as can be seen clearly in FIG. 1. As a result of the force exerted by titling the table top, the intermediate wheel 18 which bears against the edge 11 pushes the hook 9 back progressively and forces it to pivot about its axis 13 against the return force exerted by the spring 14. The effect obtained is similar to that obtained by the unlocking part 7, i.e. the hook 9 is pushed back until the passage for the intermediate wheel 18 is quite free, i.e. until it can go past the end edge 11*a* of the hook 9 and return to the top portion 12*a* of the slideway 12. At this specific moment, the hook 9 is released from the action of the intermediate wheel 18 and under drive from the return spring 14, it returns to its initial, rest position, thereby holding the intermediate wheel 18 captive in the concave indentation 8.

The second locking means is a hook 12 of structure that is very similar to that of the hook 9 as described above, with the exception that it has an extension 25 going beyond the pivot axis 27 so as to form a kind of actuator pedal for the user. This extension 25 has, towards its end, an actuator rod 26 which is mounted perpendicularly to the plane of the hook 24. The hook 24 is mounted in a manner that is symmetrical to the first hook 9, but at the bottom 12*b* of the slideway 12. Its pivot axis 27 is fixed to the support 4, vertically in register with the slideway 12, and beneath it.

To lock the intermediate wheel 18 by means of the hook 24, the operation is identical to that described above, with the wheel 18 pushing back the hook 24 by bearing against the obliquely sloping edge 28 of the hook 24. However unlocking does not require an independent part. It is the user who uses a foot to lift the actuator rod 26, thereby pivoting the hook 24 about its axis 27 and thus releasing the intermediate wheel 18 which was previously held captive in the concave indentation 29 of the hook 24.

In the above-described version, the wheel which is held captive in the locking means is an intermediate wheel. However, it could also be constituted by the positioning wheel 19 itself, inside the slideway 12. This requires slots to be made in the upright 17 of said slideway and in the support 4. Although this configuration is entirely possible, it is nevertheless more complicated to implement from a practical point of view. In addition, it is less easily accessible.

Figure 5:
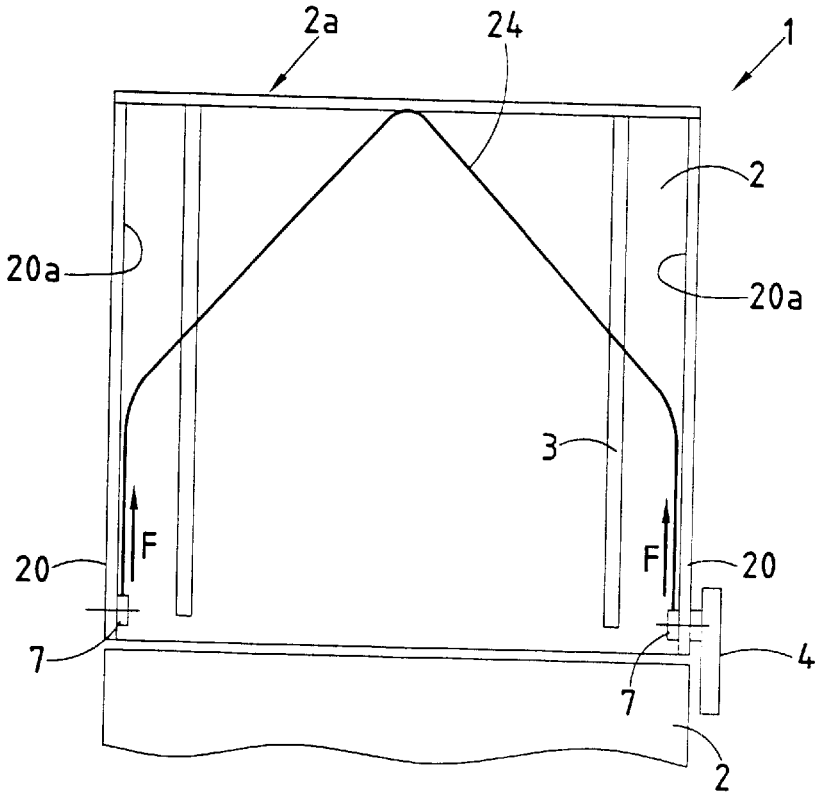
FIG. 5 is a diagrammatic view of the underside of a table top, showing the path followed by an actuator strap.

FIG. 5 shows the general path followed by a single strap 24 which connects the two unlocking parts 7 fixed to the inside faces 20*a* of the two side edges 20 of the table top 2. The path followed by the strap from each unlocking part 7 is rectilinear over about half the length of the table top after which it converges obliquely towards the middle of the transverse edge 2*a* of the table top 2. At this location, the strap is thus within reach of a user's hand when the table top is in its horizontal position for play. It suffices for the user to take hold of the strap and to exert traction thereon so as to move the strap in such a manner that its longitudinal rectilinear portions move along the arrows F, thereby actuating both unlocking parts 7 simultaneously.

The present invention is not limited to the embodiment described above in non-exhaustive manner. In this embodiment, the locking and unlocking parts move angularly by pivoting about axes that are perpendicularly to the support and to the side edge of the table top. This is not essential for the invention, and it is also possible for the locking and unlocking means to move in translation instead of by pivoting.

What is claimed is:

1. A foldable table-tennis table comprising:

a support having substantially vertical guiding slideways;

two table tops supported by said support, said table tops each having hinged legs and being movable between a horizontal position and a vertical position;

positioning wheels projecting from side edges of the two table tops, each positioning wheel extending into and being at least partially guided by a corresponding vertical guiding slideway; and locking means for each positioning wheel for locking each table top in a horizontal position for play, said locking means comprising:

an actuator means secured to the side edge of the table top and positioned to be accessible to a user;

a locking part secured to the support, said locking part being movable relative to the support and structured to engage an associated positioning wheel to hold the positioning wheel stationary in its associated vertical guiding slideway; and an unlocking part connected to the actuator means and to the locking part, said unlocking part being structured to disengage the positioning wheel from the locking part when actuated by the user.

2. The foldable table-tennis table according to claim 1, wherein the locking part is fitted with return means comprising a spring, and the unlocking part pushes back the locking part against the action of the return means.

3. A table according to claim 1, wherein the locking part is a part that pivots angularly about a transverse axis fixed to the support.

4. A table according to claim 3, wherein the locking part is a flat part forming a hook with a concave indentation, and the pivot axis thereof is fixed firstly to the support vertically in register with the guiding slideway and above it, and secondly to the hook towards the end of the concave indentation, wherein under the action of the return means in the normal, locking position, the hook is disposed in such a manner as to hold captive a wheel which is either the positioning wheel or else an intermediate wheel mounted between the positioning wheel and the side edge of the table top; and wherein the edge of the hook adjacent to its concave indentation and opposite from the pivot axis is disposed obliquely relative to the longitudinal direction of the slideway.

5. A table according to claim 4, wherein the unlocking part is an arm that pivots angularly about a transverse axis of the wheel and is fixed to the side edge of the table top, said arm having a bearing face suitable for engaging the edge of the hook.

6. A table according to claim 3, wherein the unlocking part is a part that pivots angularly about a transverse axis, fixed to the side edge of the table top.

7. The foldable table-tennis table according to claim 1, further comprising a second means for locking the table top when in a vertical position for storage and being associated with a second actuation means actuatable by the foot of the user.

8. A table according to claim 7, wherein the second locking means comprise a flat part forming a hook with a concave indentation, and having a pivot axis which is fixed firstly to the support in vertical register with the guiding slideway beneath it, and secondly to the hook towards the end of the concave indentation, wherein under the action of a return spring, when in its normal, locking position, the hook is disposed in such a manner as to hold captive a wheel which is either the positioning wheel or else an intermediate wheel mounted between the positioning wheel and the side edge of the table top; wherein the edge of the hook adjacent to the concave indentation and opposite from its pivot axis is disposed obliquely relative to the longitudinal direction of the slideway, and wherein the hook has a bottom extension extending beyond the pivot axis, which extension is provided towards its free end with a transverse bearing rod constituting the second actuator means.

* * * * *